United States Patent [19]

Lu

[11] Patent Number: 4,784,336

[45] Date of Patent: Nov. 15, 1988

[54] GRINDING MACHINE FOR REFINING LIQUID MATERIAL

[76] Inventor: Tsai-Chuan Lu, No. 26, Ho-Chung Li, Chia-E City, Taiwan

[21] Appl. No.: 24,316

[22] Filed: Mar. 10, 1987

[51] Int. Cl.[4] ..... B02C 17/16

[52] U.S. Cl. ..... 241/65; 241/171; 241/172

[58] Field of Search ..... 241/285 R, 101.2, 171, 241/172, 65, 66, 67

[56] References Cited

U.S. PATENT DOCUMENTS

| | | | |
|---|---|---|---|
| 4,059,232 | 11/1977 | Engels | 241/172 X |
| 4,108,385 | 8/1978 | Funk | 241/172 X |
| 4,273,295 | 6/1981 | Pollmann | 241/172 X |
| 4,496,106 | 1/1985 | Gross | 241/172 X |
| 4,651,935 | 3/1987 | Samosky et al. | 241/172 X |

*Primary Examiner*—Mark Rosenbaum

*Attorney, Agent, or Firm*—Kirschstein, Kirschstein, Ottinger & Israel

[57] ABSTRACT

An improved beads grinding machine for liquid material comprises a cylinder having a neck portion connected to an upper housing a transmission shaft mounted in the housing by means of two bearings, a plurality of blades secured onto the transmission shaft which extends into the cylinder, a cooling chamber around the cylinder, a sleeve secured onto the transmission shaft at the portion corresponding to the neck portion, a refined liquid material chamber between the neck portion and the sleeve, an inner ring fastened onto an inner end of the sleeve, an outer ring fastened onto an end plate which is fastened onto an inner portion of the neck portion, and a lubricant seal mounted on the transmission shaft in the vicinity of one of the bearings, said inner and outer rings being adjustable.

7 Claims, 8 Drawing Sheets

GRINDING MACHINE FOR REFINING LIQUID MATERIAL

FIELD OF THE INVENTION

This invention relates to an improved beads grinding machine for liquid material and, more particularly, to one wherein a gap between a grinding cylinder and a collection chamber is adjustable.

BACKGROUND OF THE INVENTION

Conventionally, the most relevant art of the preferred embodiments of this invention is shown in FIGS. 1, 2, 3 and 4. As shown, the prior art comprises a lower housing 51, a motor 2 mounted in the lower housing 51, a lower belt wheel 5 mounted on the driving shaft of the motor 2, an upper housing 52 right above the lower housing 51, particularly right above the position where the motor 2 is mounted, a transmission shaft 8 mounted partially in the upper housing 52 by means of two bearings 20, an upper belt wheel 7 mounted on one end of the transmission shaft 8, a transmission belt 6 connecting the upper belt wheel 7 and the lower belt wheel 5, a cylinder 1 having a neck portion 22 at one end, the cylinder 1 being fixed onto one end of the upper housing 52 with the neck portion 22, a cylindrical cooling chamber 16 mounted on the inner wall of the cylinder 1, a plurality of cooling compartments 16*a*, 16*b*, 16*c*, 16*d*, 16*e* and 16*f* provided in the cylindrical cooling chamber 16, a water inlet 13 provided on the outer end of the cylinder 1, a water outlet 17 on the inner end of the cylinder 1, a refined liquid material chamber 11 in the neck portion 22, a refined liquid material outlet 12 provided on the lower portion of the refined liquid material chamber 11, a lubricant seal 21 mounted onto the outer end of the neck portion 22 to define one wall of the refined liquid material chamber 11, a gap 10 between the inner end wall of the neck portion 22 and the transmission shaft 8 which extends outside of the upper housing 52, a plurality of blades 9 mounted on the outer end of the transmission shaft 8 which extends inside of the cylinder 1, a pump 3 mounted opposite to the motor 2 in the lower housing 51, a liquid material inlet 4 connecting the pump 3 and the cylinder 1, a plurality of glass beads 19 provided inside of the cylinder 1, a liquid material supplying tank (not given a reference number), a refined liquid material collecting tank (not given a reference number) and a power supply (not given a reference number) connected to the pump 3 and the motor 2.

According to the above disclosed prior art, the liquid material such as paint, ink, dying material, medicine, etc., is driven by the pump 3 through the liquid material inlet 4 into the cylinder 1 and simultaneously the motor 2 rotates the lower belt wheel 5. Further, the upper belt wheel 7 driven by the transmission belt 6 will rotate the transmission shaft 8. The blades 9 rotation will force the glass beads 19 to grind the liquid material. The refined liquid material will flow through the gap 10 into the refined liquid material chamber 11 and further flow out of the refined liquid material outlet 12 into the liquid material collecting tank. Simultaneously, the cooling water flows through the water inlet 13 into the cooling compartments 16*a*, 16*b*, 16*c*, 16*d*, 16*e* and 16*f* and further flows out of the water outlet 17 to prevent high temperature caused by the grinding effect from affecting the quality of the liquid material.

However, the above disclosed prior art bears the following defects:

(1) FIG. 3 shows an enlarged view of the area identified in FIG. 2 by reference character B between the end wall of the neck portion 22 and the transmission shaft 8. FIG. 4 is a front view of FIG. 3. As shown in FIGS. 3 and 4, an eccentric misalignment between the shaft 8 and the gap 10 caused during manufacturing or assembly will cause any glass beads 19 entering a larger clearance of the gap to be ground into power at a smaller clearance of the gap. The undesired powdered glass beads will mix with the refined liquid material and lower the quality of the refined liquid material at the outlet 12.

(2) As shown in FIG. 2, the lubricant seal 21 of the prior art is in contact with the transmission shaft 8. The abrasion thus caused is great. The lubricant seal 21 must be reviewed frequently. Otherwise, the lubricant will leak into the refined liquid material to spoil the quality.

(3) As shown in FIG. 2, the cooling chamber 16 is further divided into a plurality of cooling compartments. Thus, each cooling compartment, in turn, is required to be filled up with water before the water is allowed to flow into the next cooling compartment. This causes the cooling water to linger, and to mix with the heated water. As a result, the heat can not be effectively cooled down.

OBJECTS OF THE INVENTION

To obviate the above defects of the prior art, one object of this invention is to provide a preferred embodiment wherein the aforementioned gap between the cylinder and the chamber is adjustable so that the glass beads will not be ground into powder and the worn out glass beads in the cylinder will flow out with the refined liquid material.

Another object of this invention is to provide a preferred embodiment wherein the outer bearing is separated from the refined liquid material tank as a result of which the lubricant will not leak into the refined liquid material tank and the lubricant will not mix with the refined liquid material.

Still another object of this invention is to provide a preferred embodiment wherein a spiral guiding board is further provided to each cooling compartment so that the heat caused by grinding will be effectively lowered.

A further object of this invention is to provide a preferred embodiment wherein the blades are further provided with centrifugal guiding grooves for the glass beads to increase the rate of friction.

A further object of this invention is to provide a preferred embodiment wherein a centrifugal blade is mounted on the transmission shaft in vicinity of the outer end wall of the refined liquid material chamber to centrifugally propel the refined liquid material so that the pressure between the transmission shaft and the outer end wall of the refined liquid material chamber is lowered to keep the refined liquid material from leaking between the transmission shaft and the outer end of the refined liquid material chamber.

A further object of this invention is to provide a preferred embodiment wherein a female notch shaped lubricant seal is pressed by a male notch shaped ring onto the transmission shaft, the male notch shaped ring being screwed onto the transmission shaft in a direction opposite to the rotary direction of the transmission shaft so that the transmission shaft in rotation will press tight against the lubricant seal.

SUMMARY OF THE INVENTION

This invention relates to an improved beads grinding machine for liquid material wherein each cooling compartment is provided with a spiral guiding board; each blade is provided with a guiding groove; the gap for the glass beads to distill out is adjustable; the lubricant seal is provided outside of the refined liquid material chamber; a centrifugal blade is mounted on the transmission shaft in the refined liquid material chamber; and the lubricant seal in female notch shape is pressed by a male notch shaped ring onto the transmission shaft.

Other objects, merits and a further understanding of the present invention will be obtained by those having ordinary skill in the art when the following detailed description of the best mode contemplated for practicing the invention is read in conjunction with accompanying drawings wherein like numerals refer to like or similar parts:

DETAILED DESCRIPTION OF THE PREFERRED EXEMPLARY EMBODIMENT

This invention relates to an improved beads grinding machine for liquid material, more particularly to one wherein the gap for the beads to distil out is adjustable.

Figure 1:
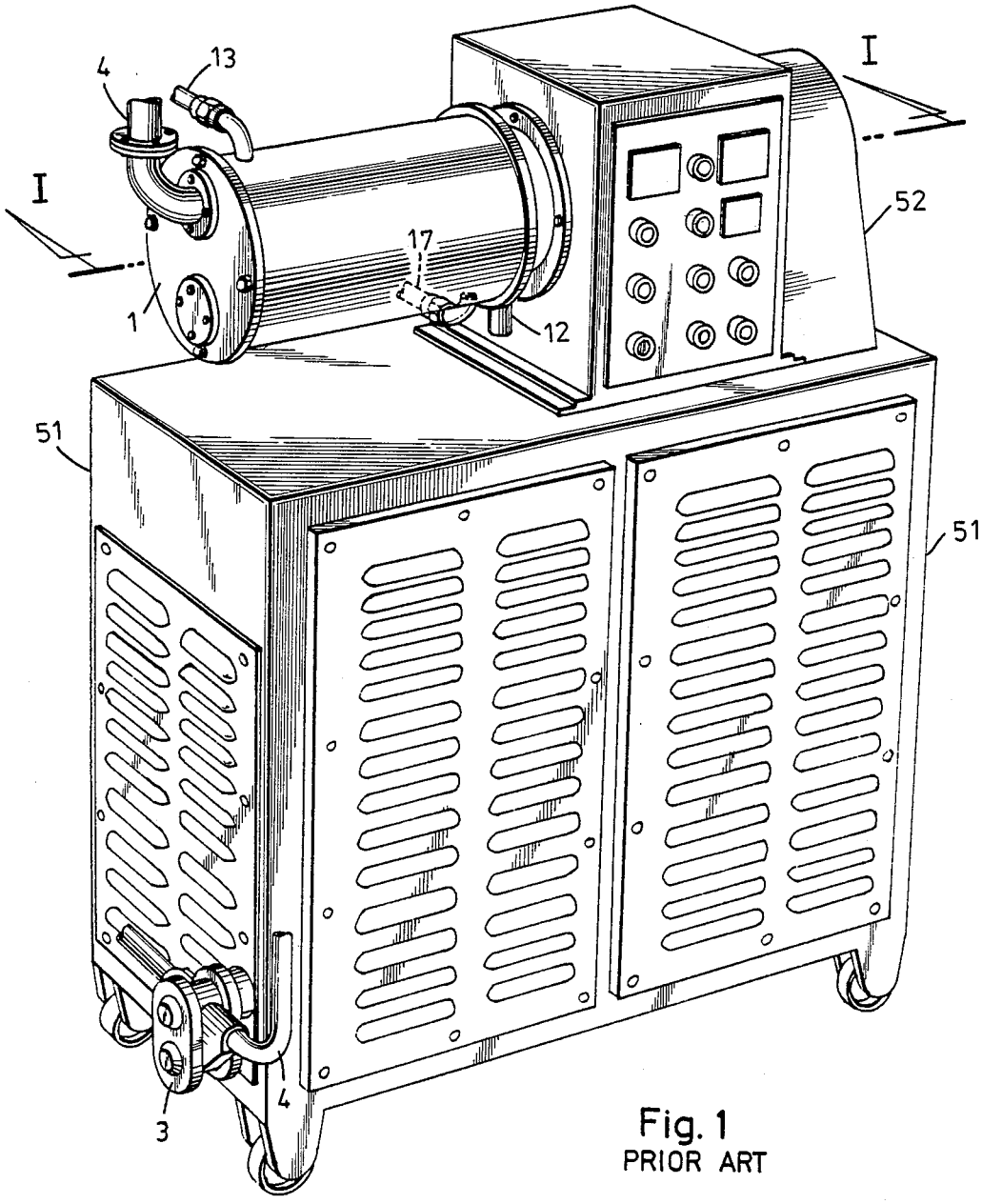
Fig. 1 PRIOR ART
FIG. 1 is a perspective view of a prior art machine.
Figure 2:
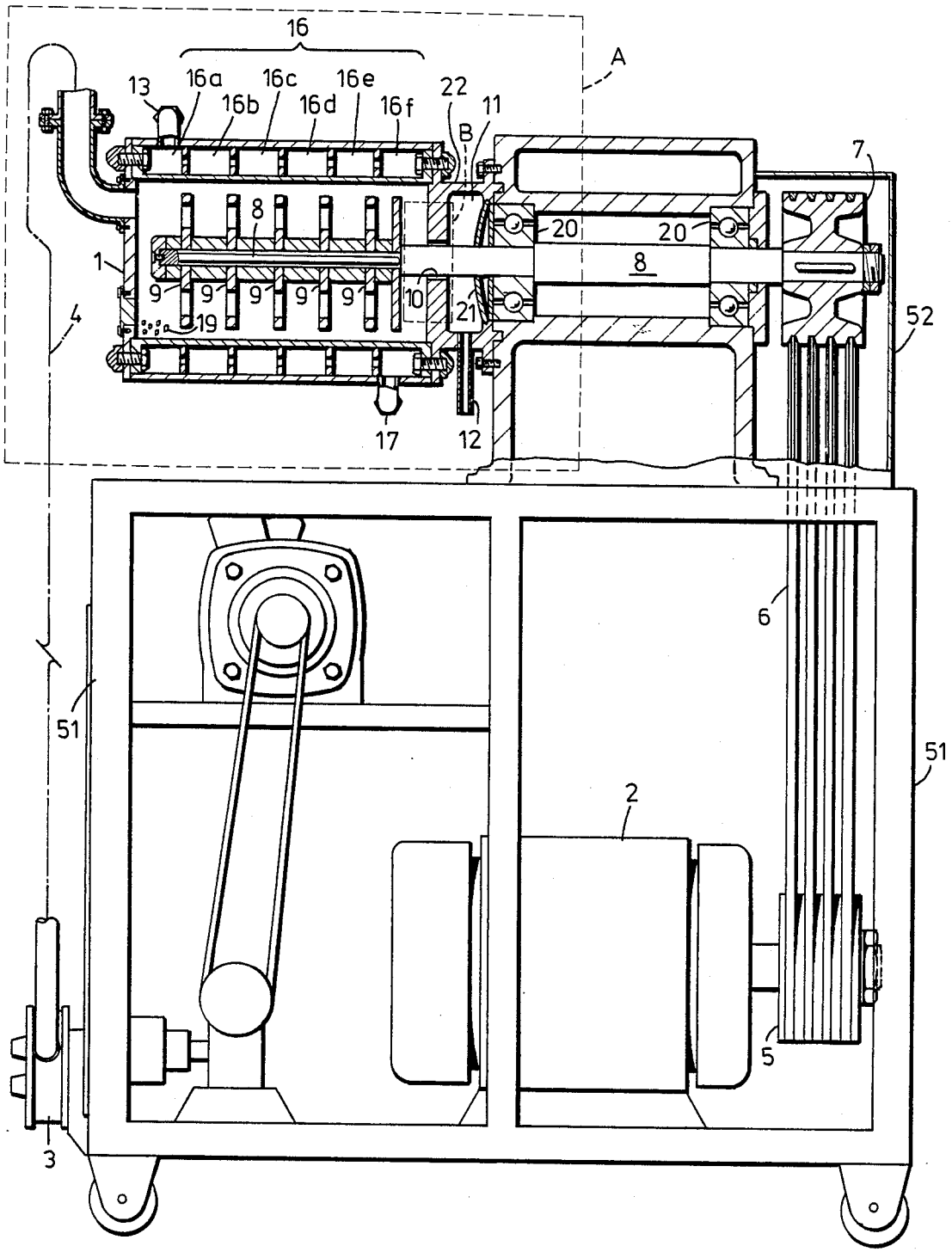
Fig. 2 PRIOR ART
FIG. 2 is a longitudinal sectional view of the prior art machine along line I—I as shown in FIG. 1.
Figure 4:
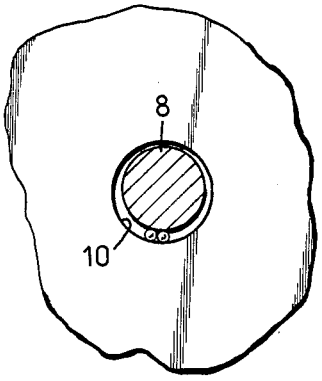
Fig. 4 PRIOR ART
FIG. 4 is a front view of FIG. 3.
Figure 3:
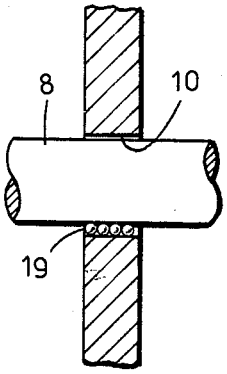
Fig. 3 PRIOR ART
FIG. 3 is an enlarged view of the area denoted by reference character B in FIG. 2.
Figure 5:
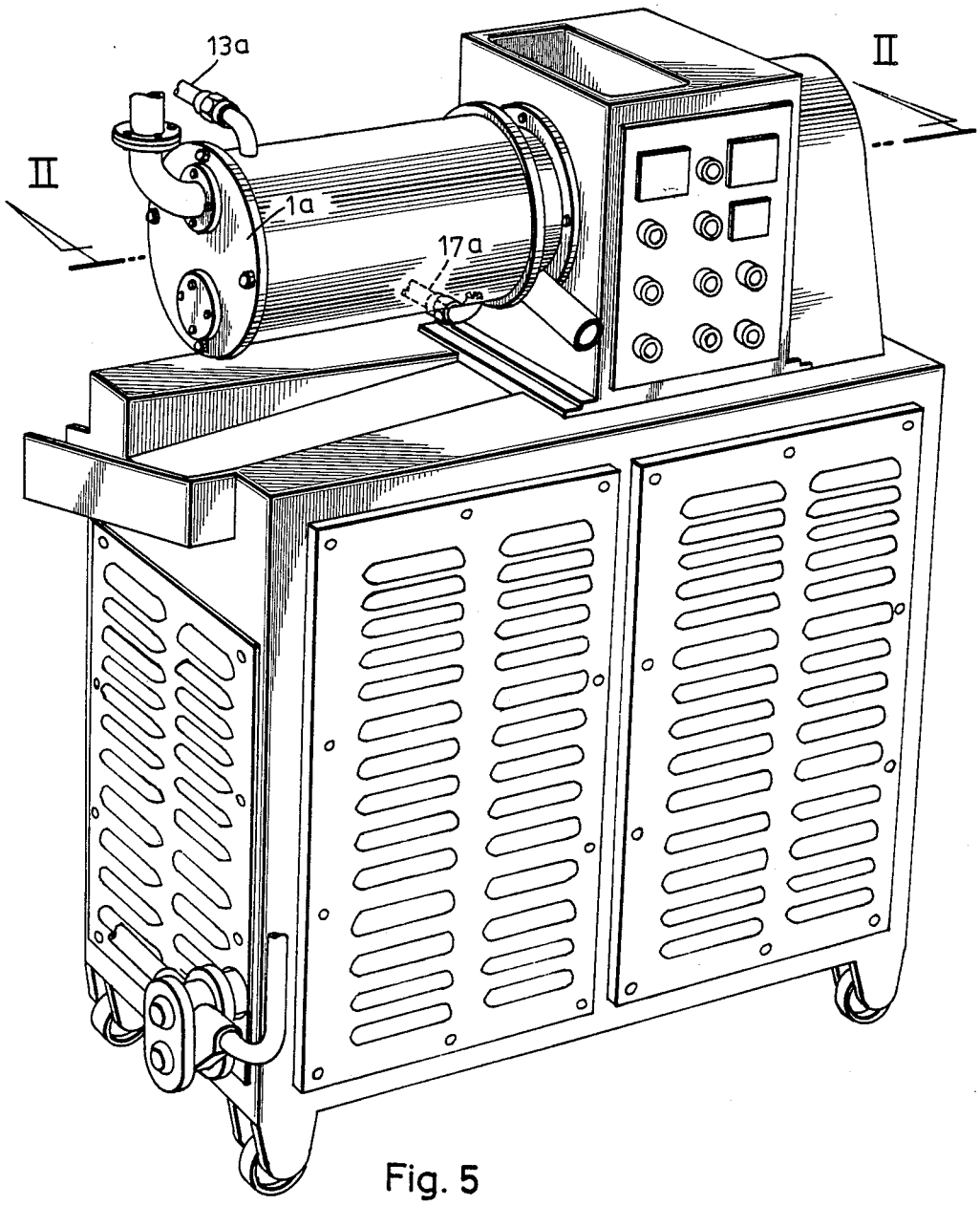
FIG. 5 is a perspective view of the present invention.
Figure 6:
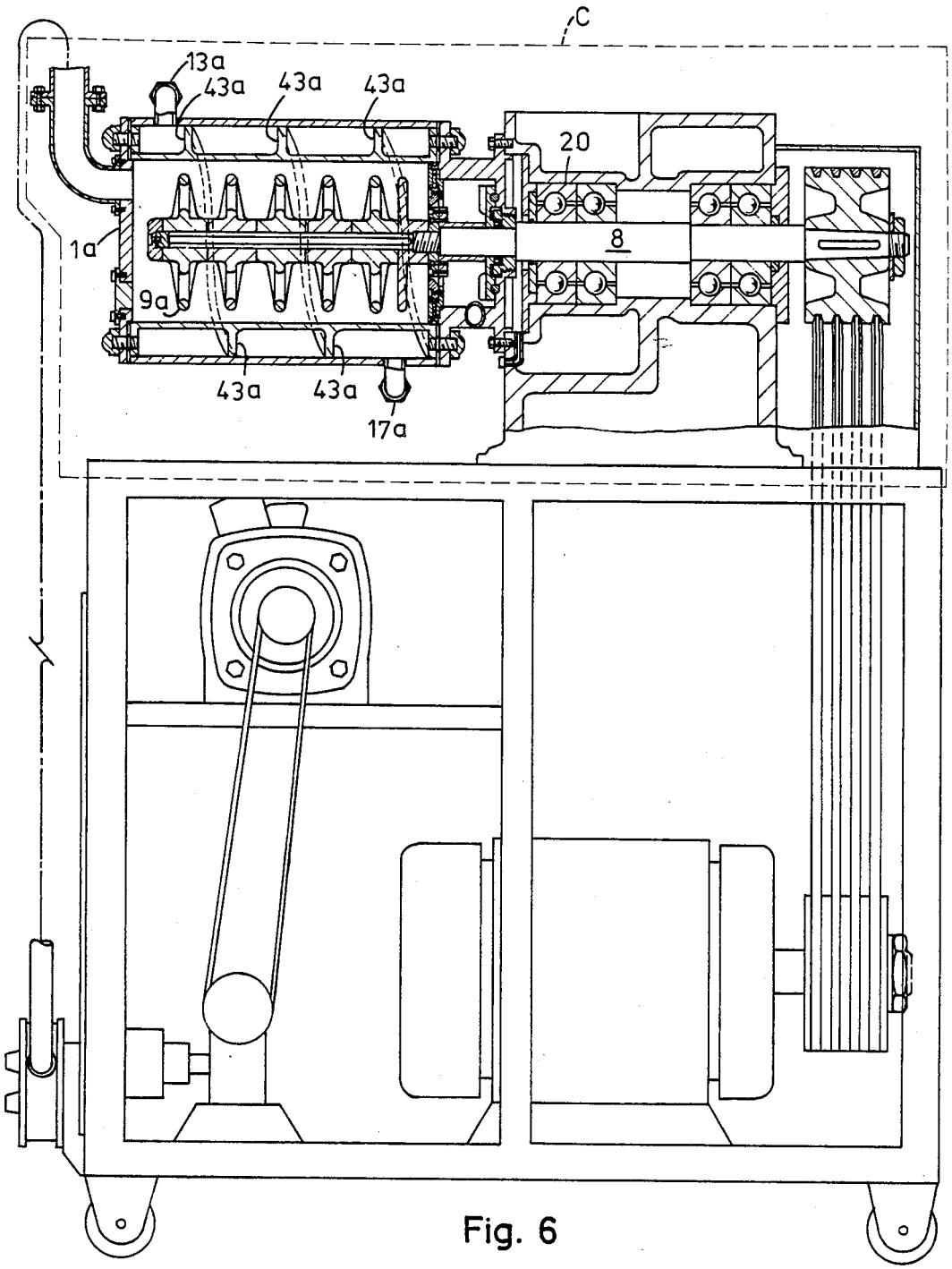
FIG. 6 is a longitudinal sectional view of the present invention along line II—II as shown in FIG. 5.
Figure 8:
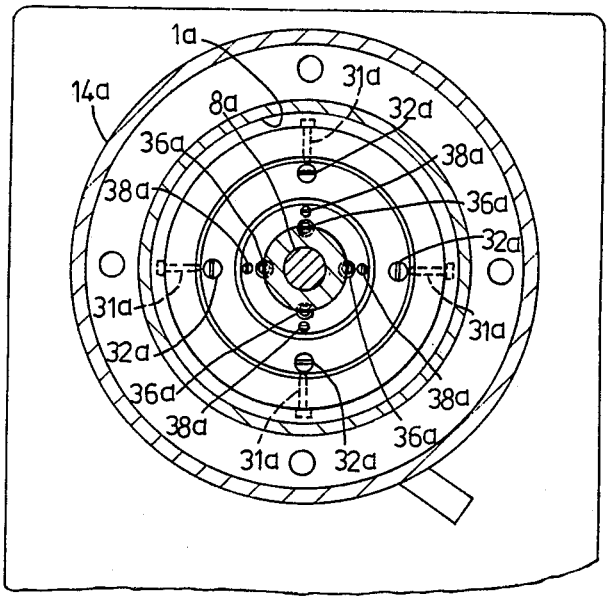
FIG. 8 is a sectional view along line III—III as shown in FIG. 7.
Figure 10:
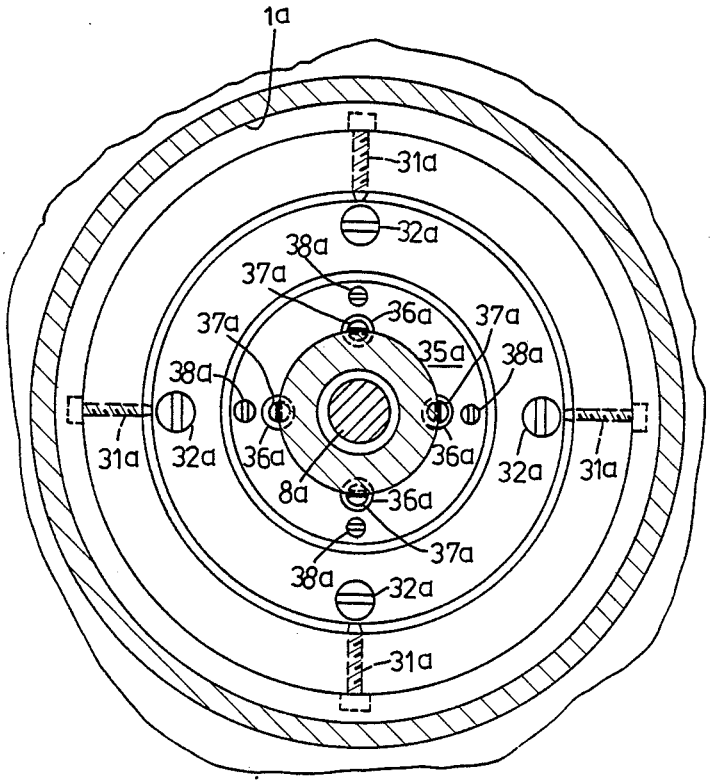
FIG. 10 is a front view of FIG. 9.
Figure 9:
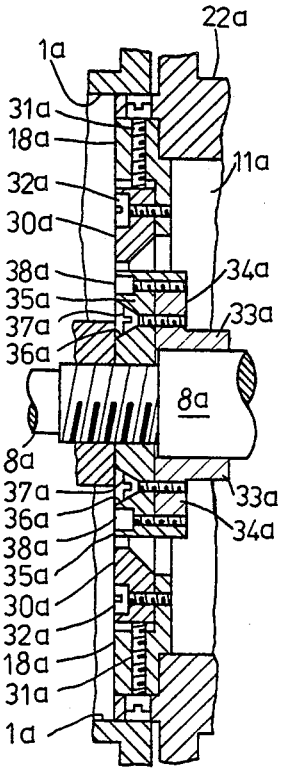
FIG. 9 is an enlarged view of the area denoted by reference character in FIG. 7.
Figure 12:
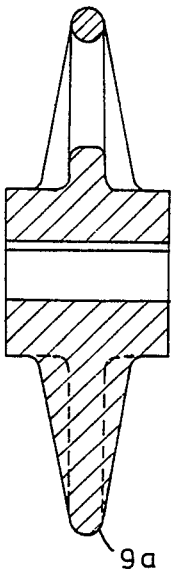
FIG. 12 is a sectional view along line IV—IV of FIG. 11.
Figure 11:
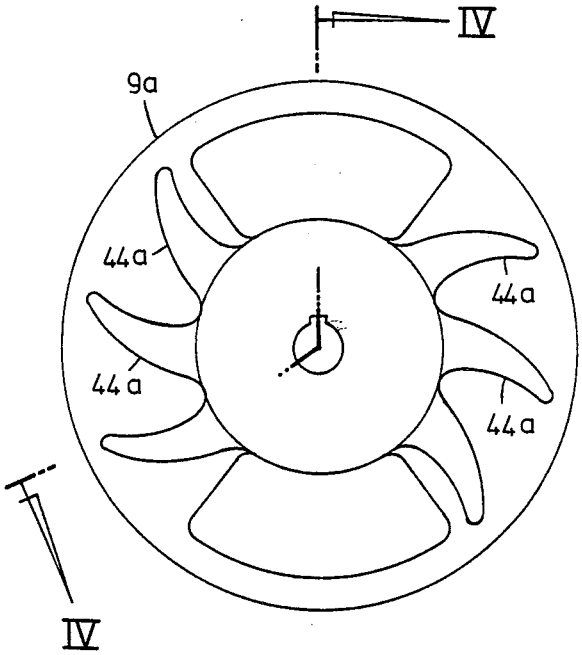
FIG. 11 is a front view of blades of the present invention.
Figure 13:
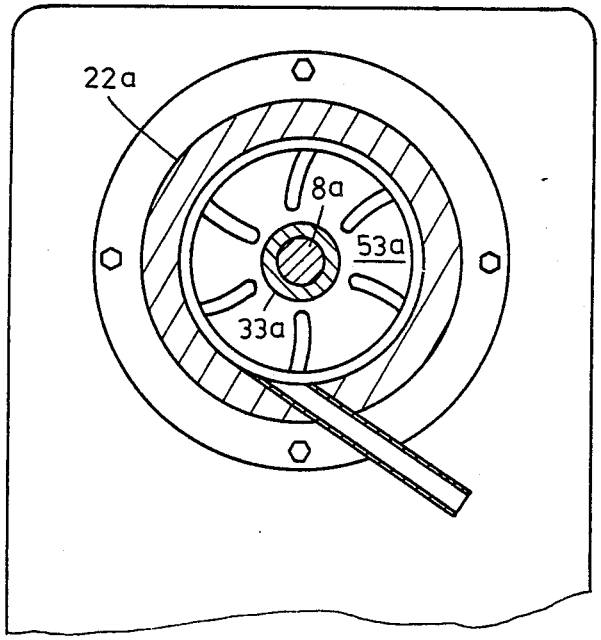
FIG. 13 is a longitudinal sectional view of the present invention along line V—V as shown in FIG. 7.

This invention is an improvement on the machine depicted in the area denoted by reference character A in FIG. 2. As shown in FIGS. 6–10, a preferred embodiment of the present invention comprises an end plate 18*a* between a cylinder 1*a* and a refined liquid material chamber 11*a*. The refined liquid material chamber 11*a* is defined by a neck portion 22*a* and a sleeve 33*a* (see FIG. 13). The end plate 18*a* is fastened by means of at least three adjustment screws 31*a* onto one end of the neck portion 22*a* in contact with the cylinder 1*a*. The radial inward portion of the end plate 18*a* in relation to a transmission shaft 8*a* has a slot (not given a reference number) to allow an outer ring 30*a* to insert therein and screw onto the end plate 18*a* by means of screws 32*a*. The outer ring 30*a* has a slope portion at the side facing the refined liquid material chamber 11*a*. The sleeve 33*a* has a circular flange 34*a* at one end thereof in contact with the cylinder 1*a*. An inner ring 35*a* is mounted onto the circular flange 34*a*. The inner ring 35*a* is provided with at least three conical threaded holes 36*a*. Correspondingly, the sleeve 33*a* is provided with at least three conical threaded holes 36*a*. Each conical threaded hole 36*a* and a corresponding conical threaded hole 36*a* constitute a screw hole for an adjustment screw 37*a* to screw therein. Further by means of a dial indicator, the adjustment screws 37*a* adjust the inner ring 35*a* so that the center of the inner ring 35*a* and that of the outer ring 30*a* become one. As shown in FIG. 8, the inner ring 35*a* may be fixed by the fastening screws 38*a* to maintain the equal distance between the inner ring 35*a* and the outer ring 30*a*. As shown in FIGS. 9 and 10, the worn out glass beads which are smaller in diameter than the distance or gap between the inner ring 35*a* and the outer ring 30*a* will distill out smoothly. Since the outer ring 30*a* has a slope portion facing the refined liquid material chamber 11*a*, the length of gap for the glass beads to pass through is shortened. As a result, the glass beads will not be ground during distillation and therefore the quality of the refined liquid material will not be spoiled. The distilled worn out glass beads may be further screened after flowing out with the refined liquid material.

Figure 7:
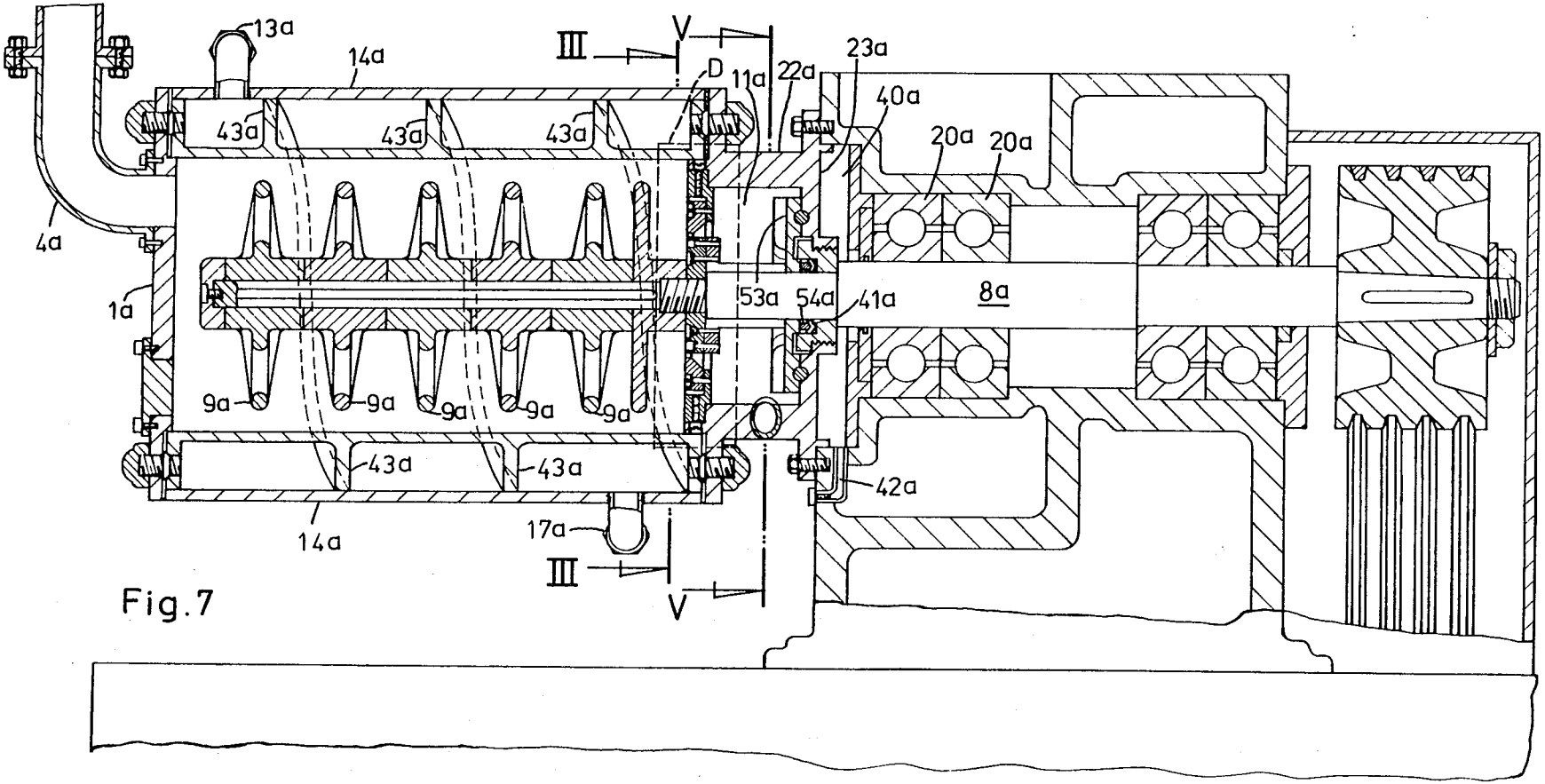
FIG. 7 is an enlarged view of the area denoted by reference character in FIG. 6.

As shown in FIG. 7, one bearing 20*a* is separated from an outer end wall 23*a* of the neck portion 22*a*, thus defining a space 40*a*. A lubricant outlet 42*a* is provided below the space 40*a*. Between the outer end wall 23*a* and the transmission shaft 8*a* there is provided a lubricant seal 41*a*. The lubricant seal 41*a* which appears in a female notch shape is pressed by a male notch shaped ring 54*a* which is pressed by a centrifugal blade 53*a* and the sleeve 33*a* in turn, said sleeve 33*a* being screwed onto the transmission shaft 8*a* in a direction opposite to the rotary direction of the transmission shaft 8*a*. The transmission shaft 8*a* in rotation will press tight against the lubricant seal 41*a*.

Further as shown in FIG. 7 a plurality of spiral guiding boards 43*a* are provided in a cooling chamber 14*a*. A water inlet 13*a* and a water outlet 17*a* are provided on the cylinder 1*a*. The water in low temperature flows from the water inlet 13*a* into the cooling chamber 14*a* where the water is guided forward by the spiral guiding board 43*a*. The heat caused by the operation of the blades 9*a* is cooled down by the water flowing through the cooling chamber 14*a*. The water thus heated flows out through the water outlet 17*a*.

As shown in FIGS. 6, 7, 11 and 12, each blade 9*a* is provided with a guiding groove 44*a* to increase the rate of friction for the glass beads. A centrifugal blade 53*a* is mounted on the transmission shaft 8*a* in the vicinity of the outer end wall 23*a* of the neck portion 22*a* to centrifugally propel the refined liquid material so that the pressure between the transmission shaft 8*a* and the outer end wall 23*a* is lowered to keep the refined liquid material from leaking between the transmission shaft 8*a* and the outer end wall 23*a*.

It is to be noted that the above description attempts to explain however not to limit the concept of this invention.

I claim:

1. A grinding machine for refining liquid material, comprising:

(A) a grinding cylinder having a longitudinal axis;

(B) a multitude of grinding bodies contained in the grinding cylinder;

(C) means for admitting liquid material to be refined into the grinding cylinder for contact with the grinding bodies;

(D) a shaft extending into the grinding cylinder along the axis, and rotatable about the axis;

(E) a set of mixer blades on the shaft within the grinding cylinder;

(F) drive means for rotating the shaft and the mixer blades about the axis to urge the grinding bodies into grinding contact with the liquid material to be refined, with concomitant generation of heat from the grinding cylinder;

(G) means for dissipating the heat generated during grinding;

(H) a refined liquid material collection chamber coaxially adjacent the grinding cylinder, for collecting the refined liquid material from the grinding cylinder, said shaft extending axially through the collection chamber;

(I) outlet means for providing communication between the grinding cylinder and the collection chamber, including (i) an end wall mounted on the chamber between the chamber and the cylinder, (ii) an outer ring supportably mounted on the end wall concentric with the axis, (iii) a hollow sleeve extending axially into the chamber and surrounding the shaft therein, said sleeve being supportably mounted on the shaft, (iv) an inner ring supportably mounted on the sleeve concentric with the axis, said inner ring being surrounded by, and bounding an annular gap with, the outer ring, and (v) radial adjustment means for radially adjusting the annular gap to have substantially the same clearance in all radial directions; and (J) means for discharging the refined liquid material collected in the collection chamber therefrom.

2. The machine according to claim 1, wherein the radial adjustment means includes a first plurality of adjustment screws mounted for movement of the outer ring from an eccentric position to a concentric position relative to the axis, and a second plurality of adjustment screws mounted for movement of the inner ring from an eccentric position to a concentric position relative to the axis.

3. The machine according to claim 1, wherein the outer ring has a sloped end wall at its axial side facing the collection chamber.

4. The machine according to claim 1, wherein the heat dissipating means includes a cooling jacket surrounding the grinding cylinder, inlet means for admitting cooling liquid into the cooling jacket, outlet means for discharging the cooling liquid from the cooling jacket, and means for guiding the cooling liquid from the inlet means to the outlet means, said guiding means including a plurality of guiding baffles helically surrounding, at least in part, the axis.

5. The machine according to claim 1, wherein each blade has curved grooves for urging the grinding bodies and the liquid material into more intimate contact during operation of the drive means.

6. The machine according to claim 1; and further comprising lubricating seal means outside of the collection chamber, for avoiding contamination of the refined liquid material within the collection chamber with the lubricant for the shaft.

7. The machine according to claim 6, wherein the seal means includes an annular recessed seal surrounding the shaft, an annular collar in sealing engagement with the recessed seal, and means for pressing the collar against the recessed seal, said pressing means including a centrifugal blade mounted on the sleeve and turnable in a circumferential direction opposite to the direction of rotation of the shaft.

* * * * *